US007220151B2

(12) United States Patent
Brehm et al.

(10) Patent No.: US 7,220,151 B2
(45) Date of Patent: May 22, 2007

(54) POWER CONNECTOR

(75) Inventors: George W. Brehm, Holmes, NY (US); Robert Nicoletti, Milton, NY (US); Kent D. Waddell, West Hurley, NY (US)

(73) Assignee: International Business Machines Corporation, Armonk, NY (US)

( * ) Notice: Subject to any disclaimer, the term of this patent is extended or adjusted under 35 U.S.C. 154(b) by 142 days.

(21) Appl. No.: 10/853,460

(22) Filed: May 25, 2004

(65) Prior Publication Data

US 2005/0266737 A1 Dec. 1, 2005

(51) Int. Cl.
*H01R 13/42* (2006.01)

(52) U.S. Cl. ..... 439/751; 439/943

(58) Field of Classification Search ..... 439/637, 439/751, 943, 63, 78, 856, 857, 947, 8
See application file for complete search history.

(56) References Cited

U.S. PATENT DOCUMENTS 3,413,594 A * 11/1968 Fernald et al. ..... 439/637
4,080,027 A 3/1978 Benasutti
4,166,667 A * 9/1979 Griffin ..... 439/637
4,671,584 A 6/1987 Barkus et al.
4,789,352 A 12/1988 Kreinberg et al.
4,834,665 A 5/1989 Kreinberg et al.
4,846,699 A 7/1989 Glover et al.
5,035,631 A * 7/1991 Piorunneck et al. ..... 439/108
5,478,259 A * 12/1995 Noschese ..... 439/607
5,616,034 A 4/1997 Masuda et al.
5,675,472 A 10/1997 Hamerton-Kelly
5,842,876 A * 12/1998 Collin et al. ..... 439/78
6,254,435 B1 7/2001 Cheong et al.
6,305,949 B1 10/2001 Okuyama et al.
6,309,254 B1 10/2001 Korsunsky
6,402,525 B2 6/2002 Gugliotti et al.
6,739,882 B2 * 5/2004 Fuehrer et al. ..... 439/95

* cited by examiner

*Primary Examiner*—James R. Harvey
(74) *Attorney, Agent, or Firm*—Lily Neff; Cantor Colburn LLP

(57) ABSTRACT

A power connector for receiving a circuit board in accordance with an exemplary embodiment is provided. The power connector includes first and second walls operably disposed on a first side of a base portion for receiving at least a portion of a circuit board therebetween. The base portion has a second side opposite the first side and a first aperture extending from the second side into the base portion. The first aperture has a first diameter. The power connector further includes at least one electrically conductive pin having both first and second compliant end portions. The first compliant end portion has a second diameter when the first compliant end portion has a non-compressed state, and a third diameter smaller than the second diameter when the first compliant end portion has a compressed state. The second diameter of the first compliant end portion is larger than the first diameter of the first aperture. The first compliant end portion is disposed within the first aperture to compressively load the first compliant end portion within the first aperture for affixing the pin to the base portion.

11 Claims, 4 Drawing Sheets

POWER CONNECTOR

TECHNICAL FIELD

The application relates to a power connector utilizing electrically conductive pins with first and second compliant end portions.

BACKGROUND

Electrical backplanes generally have multiple daughter-cards connected to the backplane that utilize both signal and power connectors to make electrical connections between the backplane and the daughter-cards.

An electrical power connector is operably coupled to an electrical backplane utilizing conductive pins that are fixedly attached to the power connector. The conductive pins have a non-compliant portion that is soldered to the power connector and another portion that is soldered to the electrical backplane. However, if one or more conductive pins are degraded or need to be replaced, the conductive pins cannot be easily replaced since they are soldered to the power connector. Instead, the entire power connector is removed and a new power connector is utilized.

Thus, there exists a need for a power connector that has conductive pins that can be easily removed from the power connector and allows the power connector to be easily removed from an electrical backplane.

SUMMARY OF INVENTION

A power connector for receiving a circuit board in accordance with an exemplary embodiment is provided. The power connector includes first and second walls operably disposed on a first side of a base portion for receiving at least a portion of a circuit board therebetween. The base portion has a second side opposite the first side and a first aperture extending from the second side into the base portion. The first aperture has a first diameter. The power connector further includes at least one electrically conductive pin having both first and second compliant end portions. The first compliant end portion has a second diameter when the first compliant end portion has a non-compressed state, and a third diameter smaller than the second diameter when the first compliant end portion has a compressed state. The second diameter of the first compliant end portion is larger than the first diameter of the first aperture. The first compliant end portion is disposed within the first aperture to compressively load the first compliant end portion within the first aperture for affixing the pin to the base portion.

A power connector for receiving a circuit board in accordance with another exemplary embodiment is provided. The power connector includes first and second walls operably disposed on a first side of a base portion for receiving at least a portion of a circuit board therebetween. The base portion has a second side opposite the first side and a first aperture extending from the second side into the base portion. The first aperture has a first diameter. The power connector further includes at least one electrically conductive pin having both first and second compliant end portions. The first compliant end portion has a second diameter when the first compliant end portion has a non-compressed state, and a third diameter smaller than the second diameter when the first compliant end portion has a compressed state. The second diameter of the first compliant end portion is larger than the first diameter of the first aperture. The first compliant end portion is disposed within the first aperture to compressively load the first compliant end portion within the first aperture for affixing the pin to the base portion. The second compliant end portion has a fourth diameter when the second compliant end portion has a non-compressed state, and a fifth diameter when the second compliant end portion has a compressed state smaller than the fourth diameter.

A method for coupling a power connector to an electrical backplane in accordance with another exemplary embodiment is provided. The power connector is coupled to the electrical backplane utilizing at least one electrically conductive pin having both first and second compliant end portions. The first compliant end portion has a first diameter when the first compliant end portion has a non-compressed state, and a second diameter smaller than the first diameter when the first compliant end portion has a compressed state. The first diameter of the first compliant end portion is larger than a third diameter of a first aperture extending into the power connector. The electrical backplane has a second aperture extending therein. The method includes inserting the first compliant end portion of the electrically conductive pin within the first aperture of the power connector to compressively load the first compliant end portion within the first aperture for retaining the first compliant end portion within the first aperture. Finally, the method includes inserting the second compliant end portion of the electrically conductive pin within the second aperture of the electrical backplane to compressively load the second compliant end portion within the second aperture for retaining the second compliant end portion within the second aperture.

BRIEF DESCRIPTION DRAWINGS

Figure 1:
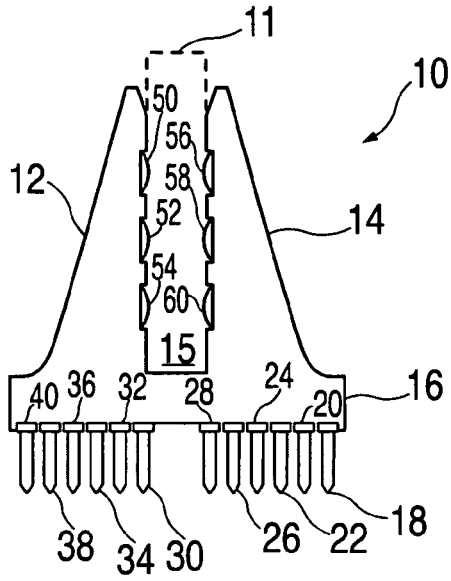
FIG. 1 is a side view of a power connector in accordance with an exemplary embodiment.
Figure 2:
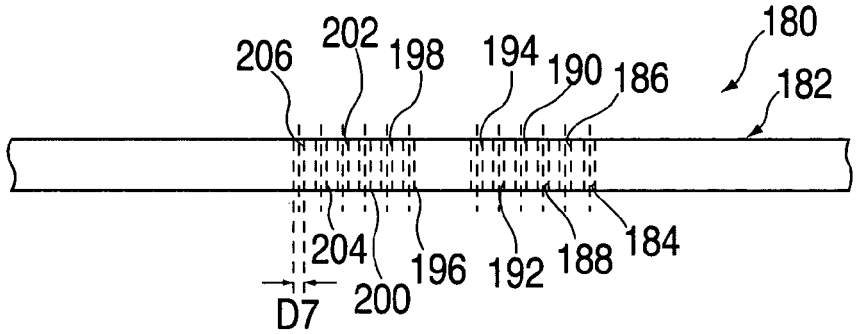
FIG. 2 is a side view of an electrical backplane configured to receive the power connector of FIG. 1.
Figure 3:
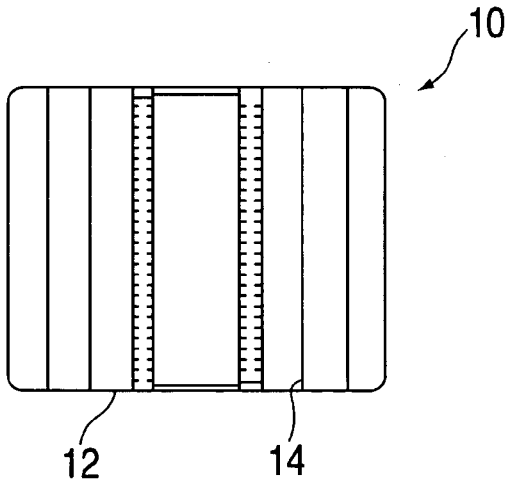
Figure 4:
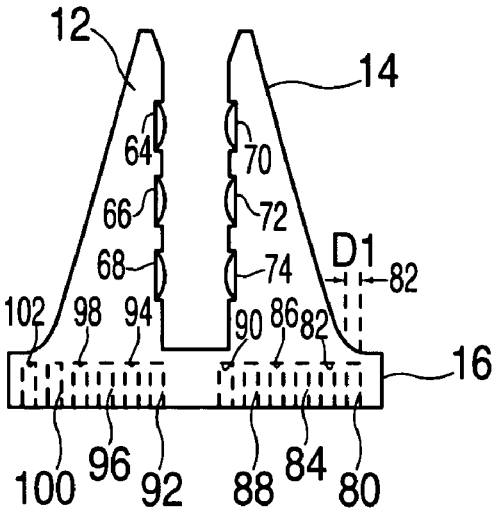
Figure 5:
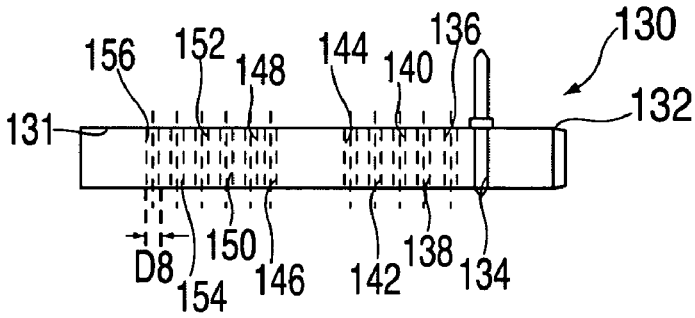
Figure 6:
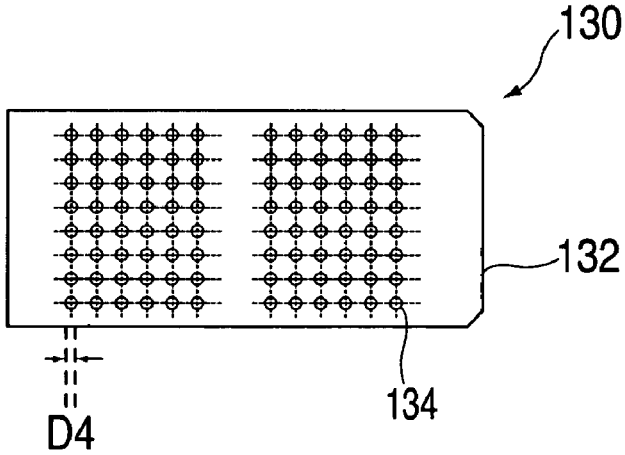
Figure 7:
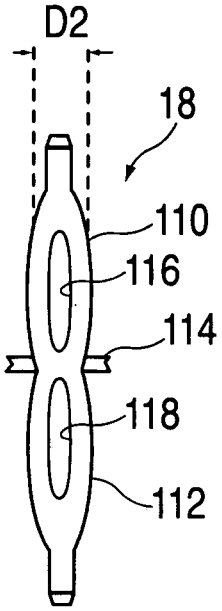
Figure 9:
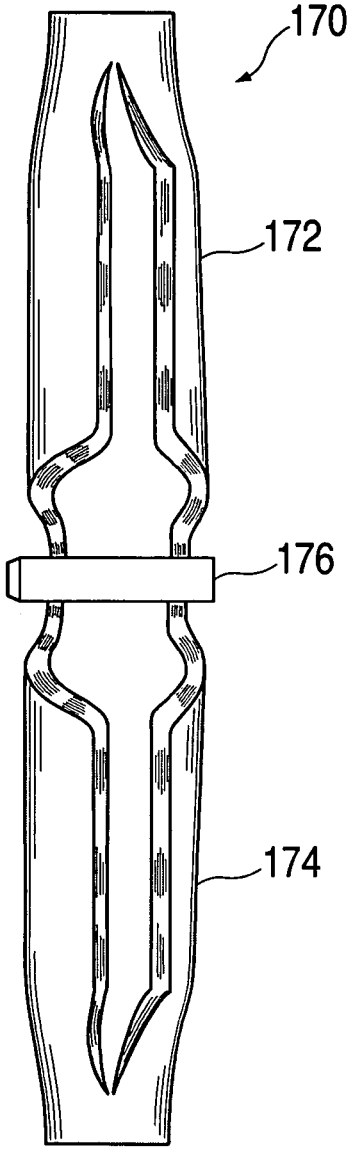
Figure 8:
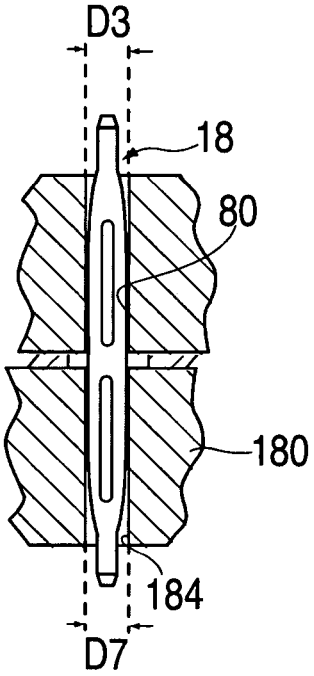
Figure 10:
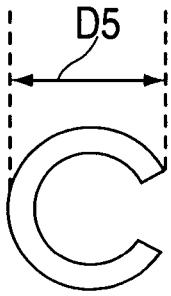
Figure 11:
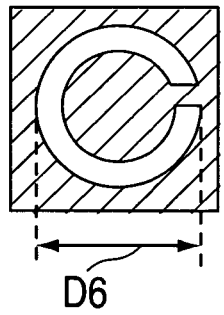
Figure 12:
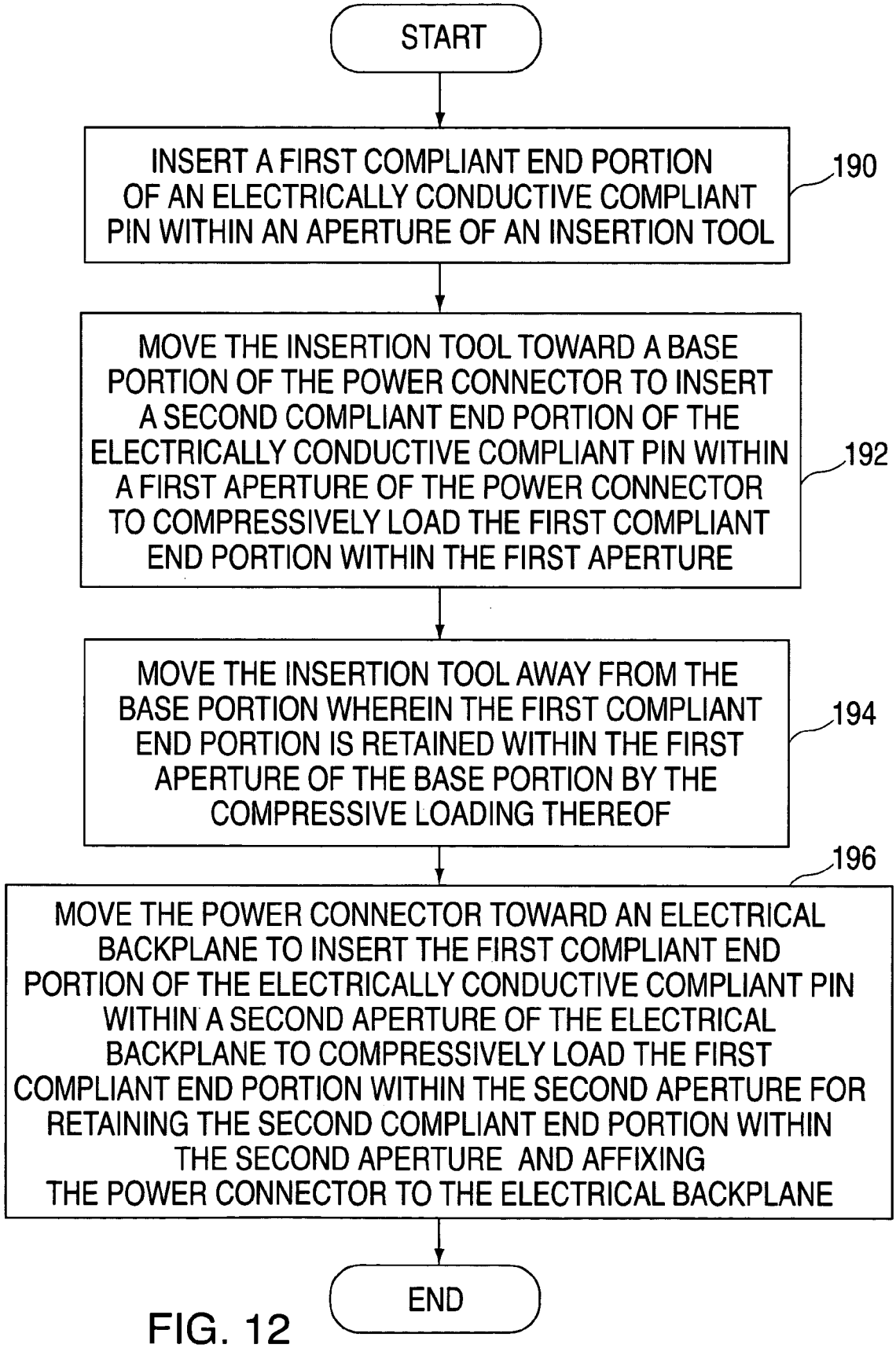

FIG. 3 as a top plan view of the power connector of FIG. 1;

FIG. 4 is a side view of the power connector of FIG. 1 prior to placement of electrically conductive compliant pins within the power connector;

FIG. 5 is a side view of an insertion tool for inserting electrically conductive compliant pins within apertures in the power connector of FIG. 4;

FIG. 6 is a top plan view of the insertion tool of FIG. 5;

FIG. 7 is a side view of a first electrically conductive compliant pin in a non-compressed state that can be utilized with the power connector of FIG. 1;

FIG. 8 is a side view of the first electrically conducting compliant pin of FIG. 7 in a compressed state;

FIG. 9 is a perspective view of a second electrically conductive compliant pin in a non-compressed state that can be utilized with the power connector of FIG. 1;

FIGS. 10 and 11 are cross-sectional views of the second electrically conductive compliant pin of FIG. 9 in a non-compressed state and a compressed state, respectively; and FIG. 12 is a flowchart of a method for coupling a power connector to an electrical backplane.

DESCRIPTION OF EMBODIMENTS

Referring to FIGS. 1 and 4, a power connector 10 for electrically coupling a circuit board to an electrical backplane 13 is provided. The power connector 10 includes walls 12, 14, a base portion 16, compliant pins 18, 20, 22, 24, 26, 28, 30, 32, 34, 36, 38, 40, and electrical contacts 50, 52, 54, 56, 58, 60. The power connector 10 can be utilized as a positive terminal to supply a positive voltage to a circuit board 11. It should be noted that another power connector 10 (not shown) could be utilized as a negative terminal to supply a negative or ground voltage to the circuit board 11.

The sidewalls 12 and 14 define a region 15 therebetween for receiving the circuit board 11. The side walls 12, 14 are integrally connected to the base portion 16 and are disposed opposite one another. The side walls 12, 14 and the base portion 16 are constructed from an electrically conductive material, such as brass, copper, silver, aluminum, or a copper-alloy material, for example. The sidewall 12 includes grooves 64, 66, and 68 for receiving and holding electrical contacts 50, 52, and 54, respectively. Similarly, the sidewall 14 includes grooves 70, 72, 74 for receiving and holding electrical contacts 56, 58, 60, respectively.

The base portion 16 is integrally connected to the walls 12, 14 and includes a plurality of apertures for receiving a plurality of electrically conductive compliant pins. In particular, base portion 16 includes apertures 80, 82, 84, 86, 88, 90, 92, 94, 96, 98, 100, 102 for receiving electrically conductive compliant pins 18, 20, 22, 24, 26, 28, 30, 32, 34, 36, 38, 40, respectively. It should be noted that although only one row of electrically conductive pins is illustrated in the power connector 10, a plurality of additional rows of conductive pins can be utilized with the power connector 10. Accordingly, the number of electrically conductive compliant pins and the position of the pins can vary based on a desired operating configuration.

Referring to FIGS. 1, 7 and 8, a side view of the electrically conductive pin 18 that can be utilized with the power connector 10 is illustrated. The electrically conductive compliant pins 20–40 have a substantially identical structure as electrically conductive compliant pin 18. The pin 18 includes a compliant end portion 110, a compliant end portion 112, and a flange 114. The compliant end portions 110, 112 are coupled together via the flange 114. Further, the compliant end portions 110, 112 both have a non-compressed outer diameter (D2) and have a substantially identical axial length. The compliant end portion 110 has an aperture 116 extending therethrough and the compliant end portion 112 has an aperture 118 extending therethrough. The apertures 116, 118 allow compliant end portions 110, 112, respectively, to deform inwardly in response to a compressive force being applied thereto. Thus, by inserting the compliant end portions 110, 112 into apertures smaller than the diameter (D2), the compliant end portions 110, 112 can be retained within respective apertures via corresponding compressive forces. In particular, when the compliant end portion 110 is inserted into an aperture 80 of the base portion 16, the compliant end portion 110 is compressed such that the diameter of portion 110 is reduced from diameter (D2) to a smaller diameter (D3) for retaining portion 110 in the aperture 80. Similarly, when compliant end portion 112 is inserted into an aperture 184 of the electrical backplane 180, the compliant end portion 112 is compressed such that the diameter of portion 112 is reduced from the diameter (D2) to the diameter (D7) for retaining portion 112 in the aperture 184.

Referring to FIGS. 1 and 5, an insertion tool 130 for inserting a plurality of compliant pins into the base portion 16 of the power connector 10 is illustrated. The insertion tool 130 includes a plate 132 having a plurality of apertures disposed of therethrough for receiving a plurality of compliant pins 18. In particular, the plate 132 includes apertures 134, 136, 138, 140, 142, 144, 146, 148, 150, 152, 154, 156 for receiving and holding compliant pins 18, 20, 22, 24, 26, 28, 30, 32, 34, 36, 38, 40, respectively. Each of the apertures of insertion tool 130 has a diameter (D8) which is larger then the diameter (D2) of the compliant end portion 112 of the pins to allow each end portion 112 to easily slide within a respective aperture without damaging the end portion 112. As shown, the flange 114 of each pin is larger than the apertures in the insertion tool 130. Thus, when the compliant pins are disposed within the apertures of the insertion tool, each flange associated with each pin rests against a top surface 131 of the insertion tool 130. Referring to FIG. 6, a plurality of additional apertures can extend through the plate 132, within each aperture is configured to hold a compliant pin for inserting the pin within the base portion 16. The insertion tool 130 is operably coupled to a movable member (not shown) that can move the plate 132 holding the compliant pins towards the base portion 16 to insert the compliant pins within respective apertures in the base portion 16.

Referring to FIGS. 9–11, an alternate embodiment of a power connector 10 utilizes a plurality of pins having an identical structure as the electrically conductive compliant pin 170. As shown, the pin 170 includes a compliant end portion 172, a compliant end portion 174, and a flange 176. The compliant end portions 172, 174 are coupled together via the flange 176. The end portions 172, 174 both have a non-compressed outer diameter (D5) and a substantially identical axial length. The compliant end portion 172 has a substantially C-shaped cross-sectional profile defining the non-compressed outer diameter (D5). Similarly, the compliant portion 174 has a substantially C-shaped cross-sectional profile.

By inserting the compliant end portions 110, 112 in apertures smaller than the non-compressed diameter (D5), the end portions 110, 112 can be retained within respective apertures via corresponding compressive forces. Thus, when the compliant end portion 172 is inserted into an aperture 80 of the base portion 16, the portion 172 is compressed such that the diameter of portion 172 is reduced from diameter (D5) to a smaller diameter (D6) for retaining portion 172 in the aperture 80 wherein (D6) is equal to (D1). Similarly, when the compliant end portion 174 is inserted into an aperture 184 of the electrical backplane 180, the portion 174 is compressed such that the diameter of the portion 174 is reduced from the diameter (D5) to the diameter (D7) for retaining portion 174 in the aperture 184.

Referring to FIG. 12, a method for coupling the power connector 10 to the electrical backplane 180 will now be described. It should be noted that although only one electrically conductive compliant pin will be explained in the method for purposes of simplicity, a plurality of additional electrically conductive compliant pins can be utilized to couple the power connector 10 to the electrical backplane 180. Further, although an electrically conductive compliant pin having a structure identical to pin 18 will be utilized in the following method, it should be understood that any electrically conductive compliant pin, that is compliant on both ends, may be utilized in the following method.

At step 190, a compliant end portion 112 of the electrically conductive compliant pin 18 is inserted within an aperture 134 of the insertion tool 130.

At step 192, the insertion tool 130 is moved toward the base portion 16 of the power connector 10 to insert the compliant end portion 110 of the pin 180 within the aperture 80 of the power connector 10 to compressively load the compliant end portion 110 within the aperture 80.

At step 194, the insertion tool 130 is moved away from the base portion 16 wherein the compliant end portion 110 is retained within the aperture 80 of the base portion 16 by a compressive force applied thereto.

At step 196, the power connector 10 is moved towards the electrical backplane 180 to insert the compliant end portion 112 of the electrically conductive compliant pin 10 within an aperture 184 of the electrical backplane 180 to compressively load the compliant end portion 112 within the aperture 184 for retaining the portion 112 within the aperture 184 and affixing the power connector 10 to the electrical backplane 180.

The power connector and the method for coupling a power connector to an electrical backplane represents a substantial advantage over other systems and methods. In particular, by utilizing an electrically conductive compliant pin having first and second compliant end portions, the pins attached to the power connector can be easily removed from the power connector if the pins become degraded, without having to replace the entire power connector. Further, by allowing the easy insertion of the pins within the power connector, the configuration or placement of the pins on the power connector can be easily changed if needed, without having to replace the entire power connector. Still further, by allowing easy insertion and removal of the pins in the power connector the number of pins in the power connector can be easily increased or decreased to obtain a desired ampacity and impedance.

While the invention is described with reference to an exemplary embodiment, it will be understood by those skilled in the art that various changes may be made and equivalence may be substituted for elements thereof without departing from the scope of the invention. In addition, many modifications may be made to the teachings of the invention to adapt to a particular situation without departing from the scope thereof. Therefore, is intended that the invention not be limited to the embodiment disclosed for carrying out this invention, but that the invention includes all embodiments falling with the scope of the intended claims. Moreover, the use of the term's first, second, etc. does not denote any order of importance, but rather the term's first, second, etc. are used to distinguish one element from another.

What is claimed is:

1. A power connector for receiving a circuit board, comprising:

first and second walls operably disposed on a first side of a base portion for receiving at least a portion of a circuit board therebetween, the base portion having a second side opposite the first side and a first aperture extending from the second side into the base portion, the first aperture having a first diameter; and at least one electrically conductive pin comprising a first compliant end portion, a second compliant end portions, and a flange portion disposed between the first and second compliant end portions, the first compliant end portion having a second diameter when the first compliant end portion has a non-compressed state, and a third diameter smaller than the second diameter when the first compliant end portion has a compressed state, the second diameter of the first compliant end portion being larger than the first diameter of the first aperture, the first compliant end portion being disposed within the first aperture to compressively load the first compliant end portion within the first aperture for affixing the pin to the base portion, the flange portion having a fixed diameter larger than the first diameter of the first aperture, the flange portion being configured to abut against the second side of the base portion.

2. The power connector of claim 1, wherein the second compliant end portion has a fourth diameter when the second compliant end portion has a non-compressed state, and a fifth diameter smaller than the fourth diameter when the second compliant end portion has a compressed state, the fourth diameter of the second compliant end portion being larger than a sixth diameter of a second aperture in an electrical backplane, the second compliant end portion being disposed within the second aperture to compressively load the second compliant end portion within the second aperture for affixing the pin to the electrical backplane, the fixed diameter of the flange portion being larger than the sixth diameter of the second aperture, the flange portion being configured to abut against the electrical backplane.

3. The power connector of claim 1, wherein at least a portion of the first compliant end portion has a c-shaped cross-sectional profile.

4. The power connector of claim 1, wherein the first compliant end portion has a second aperture extending therethrough for allowing the first compliant end portion to deform inwardly in response to a compression force.

5. The power connector of claim 1, further comprising a plurality of spring contacts disposed on the first wall and a second plurality of spring contacts disposed on the second wall.

6. The power connector of claim 5, wherein the electrically conductive pin is electrically connected to at least one of the first and second walls.

7. The power connector of claim 1, wherein the first and second walls and the base portion are constructed from an electrically conductive material.

8. The power connector of claim 7, wherein the first and second walls and the base portion are constructed from at least one of brass, copper, aluminum, or a copper alloy.

9. A power connector for receiving a circuit board, comprising:

first and second walls operably disposed on a first side of a base portion for receiving at least a portion of a circuit board therebetween, the base portion having a second side opposite the first side and a first aperture extending from the second side into the base portion, the first aperture having a first diameter; and at least one electrically conductive pin comprising a first compliant end portion, a second compliant end portions, and a flange portion disposed between the first and second compliant end portions, the first compliant end portion having a second diameter when the first compliant end portion has a non-compressed state, and a third diameter smaller than the second diameter when the first compliant end portion has a compressed state, the second diameter of the first compliant end portion being larger than the first diameter of the first aperture, the first compliant end portion being disposed within the first aperture to compressively load the first compliant end portion within the first aperture for affixing the pin to the base portion, the flange portion having a fixed diameter larger than the first diameter of the first aperture, the flange portion being configured to abut against the second side of the base portion, wherein the second compliant end portion has a fourth diameter when the second compliant end portion has a non-compressed state, and a fifth diameter when the second compliant end portion has a compressed state smaller than the fourth diameter.

10. The power connector of claim 9, wherein the first and second walls and the base portion are constructed from an electrically conductive material.

11. The power connector of claim 9, wherein the first and second walls and the base portion are constructed from at least one of brass, copper, aluminum, or a copper alloy.

* * * * *